US005275662A

United States Patent [19]

Wendler et al.

[11] Patent Number: 5,275,662

[45] Date of Patent: Jan. 4, 1994

[54] FLOORING MATERIAL APPLICATOR

[76] Inventors: Diethard Wendler, 1456 Kirkrow Crescent, Mississauga, Ontario, Canada, L5M 3Y4; Corrado Monaco, 193 Bourbon St., Woodbridge, Ontario, Canada, L4L 6Z1

[21] Appl. No.: 783,188

[22] Filed: Oct. 28, 1991

[51] Int. Cl.[5] ..... B05C 11/02; B05C 5/00; B28C 7/04

[52] U.S. Cl. ..... 118/612; 118/110; 118/108; 118/100; 118/305; 222/166; 414/421; 366/33; 366/181

[58] Field of Search ..... 118/108, 110, 112, 612, 118/305, 100; 366/181, 33, 26, 177; 222/166; 414/419, 421

[56] References Cited

U.S. PATENT DOCUMENTS

| | | | |
|---|---|---|---|
| 923,868 | 6/1909 | Lyback | 366/181 |
| 1,017,256 | 2/1912 | Fox | 118/412 |
| 3,240,184 | 3/1966 | Lemieux et al. | 118/108 |
| 3,305,887 | 11/1964 | Turner | 118/108 |
| 3,453,988 | 10/1967 | Trent | 118/108 |
| 3,801,074 | 4/1974 | Montigny et al. | 366/33 |
| 3,804,696 | 4/1974 | Lobmeier | 118/305 |
| 4,471,713 | 9/1984 | Cote et al. | 118/108 |
| 4,532,882 | 8/1985 | Ciraud | 118/108 |
| 4,533,423 | 8/1985 | Johnson | 156/356 |
| 4,789,265 | 12/1988 | Wilson et al. | 118/108 |
| 4,855,004 | 8/1989 | Chitjian | 156/359 |
| 5,109,790 | 5/1992 | Matsumoto et al. | 118/305 |

*Primary Examiner*—W. Gary Jones
*Assistant Examiner*—Steven P. Griffin

[57] ABSTRACT

A flooring material applicator having a frame and wheels rendering it moveable about a floor, a mixer chamber and agitator to mix flooring material, a first component receptacle movably mounted adjacent the mixer chamber and moveable between a first loading position, and a second dumping position, a second component receptacle movably mounted adjacent the mixer chamber, and moveable between a first loading position and a second dumping position, a distribution opening in the mixer chamber, and a door movably operable to open and close the same, a distribution chamber adjacent the door, to receive flooring material therefrom, a motor for operating the agitator, the first component receptacle, the second component receptacle, and the door, and controls for guiding the applicator about a floor, so as to spread the flooring material on a floor.

10 Claims, 5 Drawing Sheets

FIG 3
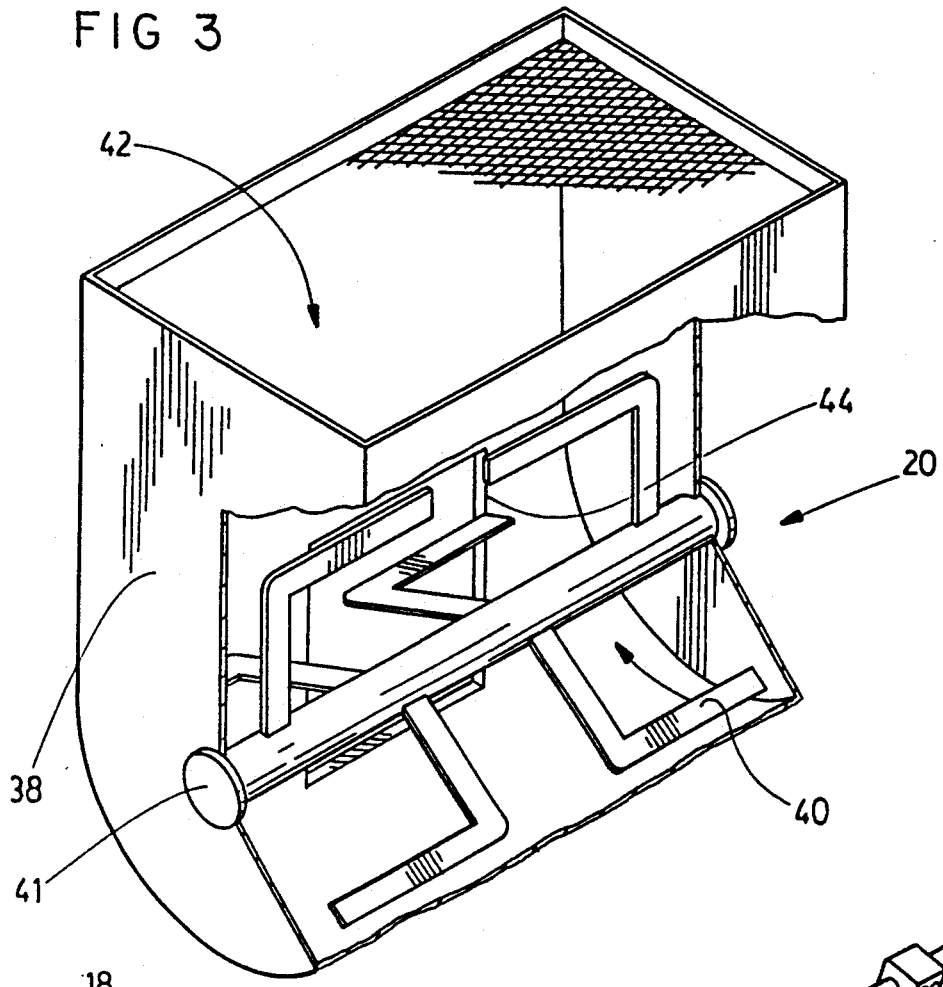
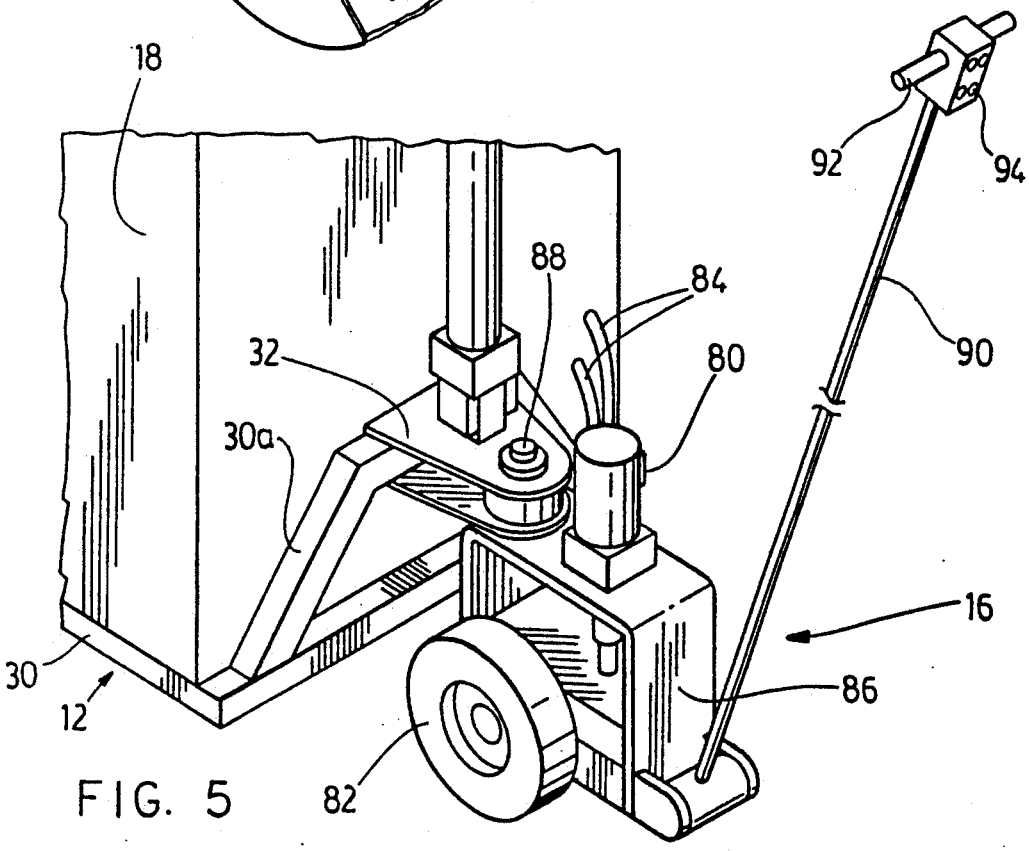
FIG. 5

FLOORING MATERIAL APPLICATOR

FIELD OF THE INVENTION

The invention relates to an apparatus for mixing, and applying, a synthetic floor covering material.

BACKGROUND OF THE INVENTION

In the construction of floors, particularly load-bearing floors such as concrete or the like, in industrial buildings, it is often desirable to apply some form of surface coating. For example, in industrial plants, a concrete flooring surface may become contaminated, and difficult to clean. It may become damaged or eroded, and frequently is a source of dust. Accordingly, coating systems of various types and various mixtures have been applied in the past to overcome some or all of these problems. One particularly popular form of coating system is a multi-component synthetic floor covering system, based on a resin type of material, a curing agent or catalyst, with suitable fillers, and other well known compounds.

Such multi-component systems provide a hard durable finish, which both protects the concrete itself from deterioration, and also allows the application of a skid resistant surface, if desired.

It is well known that these multi component systems must be mixed in more or less precisely measured proportions, and that they have a relatively short "pot" life during which they can be successfully applied. After this relatively short span of time, chemical reactions take place, and further application of the mixture becomes difficult if not impossible.

Accordingly, it is well known that it is necessary to mix and apply these flooring systems in relatively small batches.

In addition, it is a common experience, particularly in the case of a concrete floor, that the floor will not be perfectly smooth and level. It is, therefore, likely in the majority of cases that in order to provide a smooth level finish for the surface compound, it would be necessary to apply the surface compound in greater quantities in some places and lesser quantities in others.

It is also well known that in the application of such systems, it is necessary to trowel or smooth each batch of the surface material by some manual operation or power-operated operation, in order to both ensure a good permanent bond with the surface of the concrete, and also to ensure an even smooth finish to the surface before the batch has cured. While all of these individual factors have generally speaking been appreciated and understood in the past, in the practice of laying such floor surfaces, it has usually been the case that the steps were carried out as separate steps, and not as part of a continuous controlled process. As a result, there tended to be certain variations in the proportions of mix, and in the characteristics of batches of mix, from one batch to another.

In addition, there tended to be variations in the degree or consistency of the trowelling, or other surface finishing, and there were certain irregularities in the level of the surface of the finished material.

In addition, the application of such systems in the past has been very time consuming and required a very considerable amount of relatively skilled hand labour. In addition the time required for such a floor application interfered with the use of the plant causing lengthy downtime and lost production. All of these factors have tended either to reduce customer satisfaction with the end product, or to increase its cost to the customer, so that the maximum benefits from such floor surfacing systems have not been achieved.

BRIEF SUMMARY OF THE INVENTION

With a view to satisfying the various conflicting objectives described above, the invention comprises a flooring material applicator device for applying a flooring material said material having a granular component and a liquid component to a floor and comprising frame means, and wheel means therefore rendering said frame means moveable about a floor, a mixer chamber means, and agitator means located therein, and being moveable therein whereby to mix said granular and liquid components of said flooring material therein, a first component receptacle for receiving said granular component movably mounted adjacent, said mixer chamber means, and being moveable between a first loading position and a second dumping position, wherein the contents thereof is dumped into said mixer chamber means, first movement means connected to said first receptacle for procuring movement thereof as aforesaid, a second component receptacle, for receiving said liquid component movably mounted adjacent said mixer chamber means, and being moveable between a first substantially upright loading position and a second dumping position, wherein the contents thereof may be dumped into said mixer chamber means second means connected to said second receptacle for procuring movement thereof as aforesaid; a distribution opening in said mixer chamber means, and door means movably operable to open and close the same, distribution chamber means adjacent said opening, whereby to receive flooring material therefrom when said door means is in its open position, power-operated means for operating said agitator, and said door means, and control means for said device whereby the same may be guided about a floor, whereby flooring material deposited in said distribution chamber means from said mixer chamber means, may be spread about a floor, during movement of said device.

The invention further comprises such an applicator device and wherein said frame means defines a front end and a rear end, and wherein said distribution chamber means is mounted adjacent said rear end, whereby said device may be moved in a forward direction, with said front end leading and said rear end trailing, with said material being deposited behind said device.

The invention further comprises such a device and wherein said first component receptacle is of a first predetermined size and wherein said second component receptacle is of a second predetermined size different from said first predetermined size, whereby to provide for measuring of respective first and second components of said flooring material prior to mixing.

The invention further comprises such a device and wherein said distribution chamber means comprises a generally rectangular box-like structure, and releasable attachment means for securing the same in position adjacent said opening in said mixer chamber means.

The invention further comprises such a device and wherein said wheel means includes at least one pair of wheel members, and means for adjustably raising and lowering said wheel members, whereby the level of said frame means relative to a floor may be adjusted.

The invention further comprises such a device and wherein said wheel means includes front wheel means, and power-operated means for driving the same, and means for controlling said power-operated means, whereby said device may be controllably moved by said power-operated means around said floor.

The invention further comprises such a device and including trowelling means mounted on said frame means, adjacent the rear of said device, and operable to apply surface treatment to said flooring material.

The invention further comprises such a device wherein said first movement means comprises a first power cylinder connected to said first receptacle, whereby to procure said movement of said first receptacle between said first loading position and said dumping position and back again.

The invention further comprises such a device and wherein said second movement means comprises a power cylinder, connected to said second receptacle, whereby to procure movement thereof from said first loading position, to said second dumping position, and back again.

The invention further comprises such a device wherein said releasable attachment means comprises hook members secured to said distribution chamber means, and abutment members secured to said frame means, said hook members being interengagable with said abutment members, and further including screw locking devices extending between said mixing chamber means and said distribution means, said screw locking devices and said hook members cooperating to hold said distribution chamber means securely against said mixing chamber means.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

FIG. 3 is an enlarged perspective illustration of the mixer portion of the applicator of FIG. 1;

FIG. 5 is an enlarged perspective of the front wheel drive portion;

DESCRIPTION OF A SPECIFIC EMBODIMENT

Figure 1:
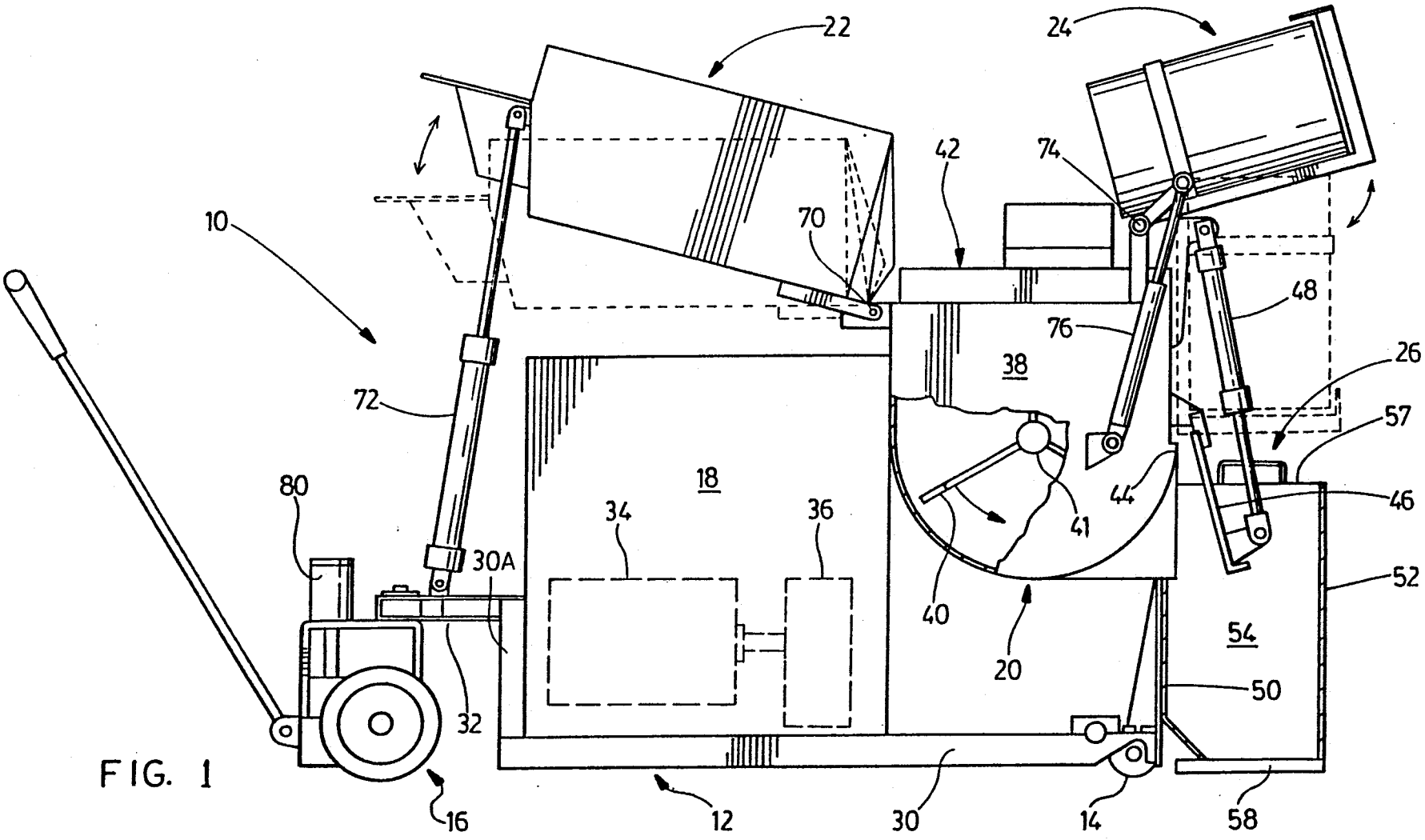
FIG. 1 is a side elevational view of a floor surface applicator, in accordance with the invention.
Figure 2:
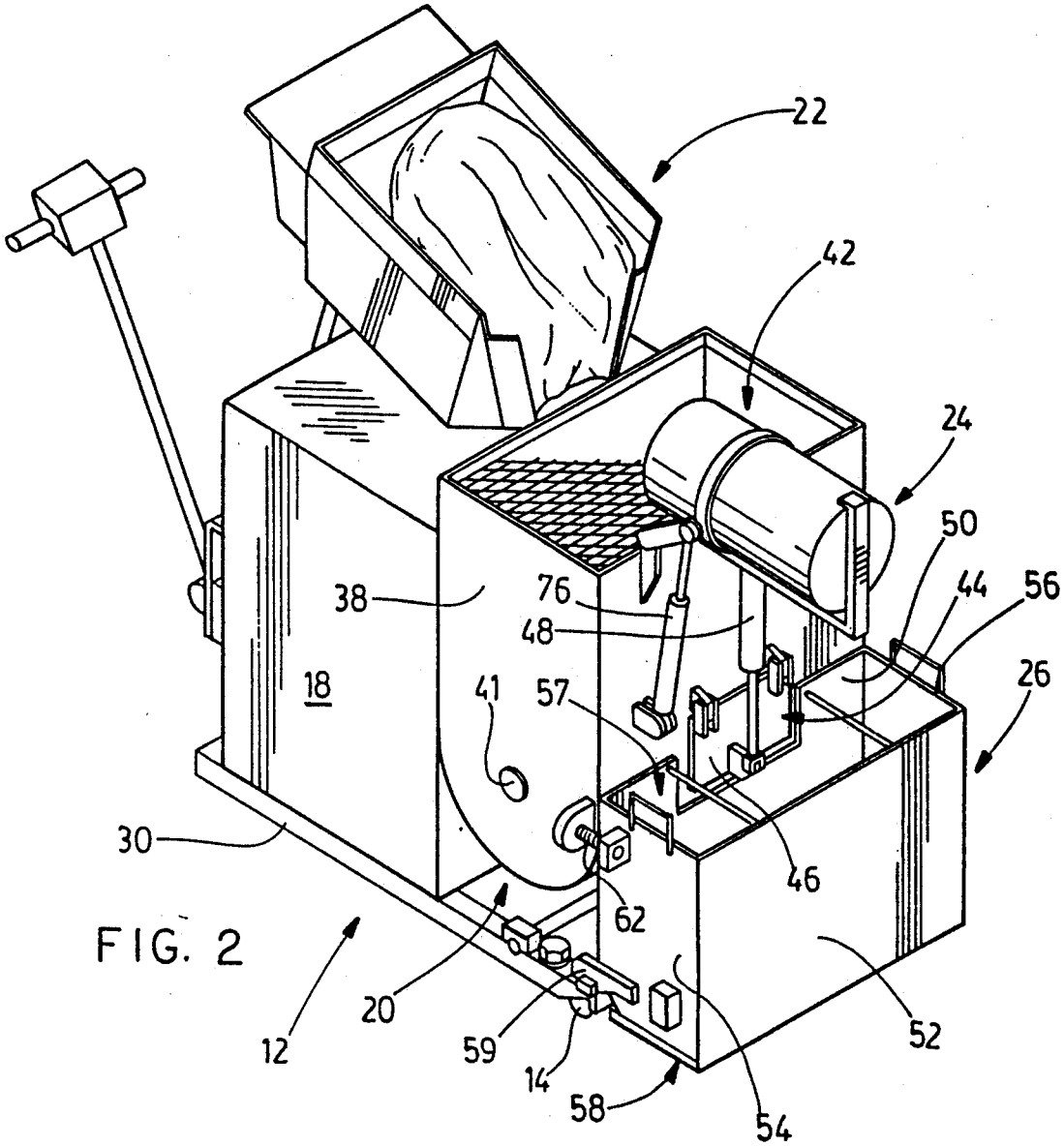
FIG. 2 is a perspective illustration of the applicator.
Figure 6:
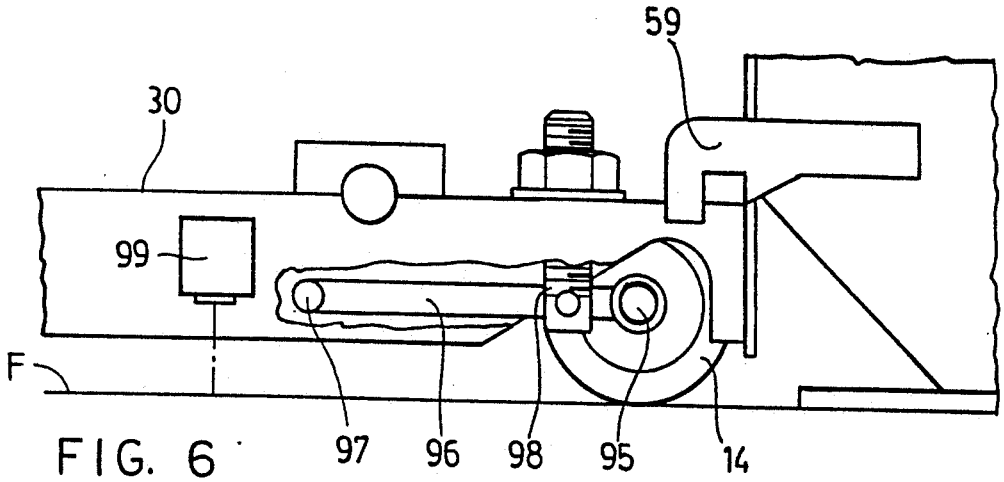
FIG. 6 is a side elevation of the rear wheel adjusting mechanism.
Figure 4:
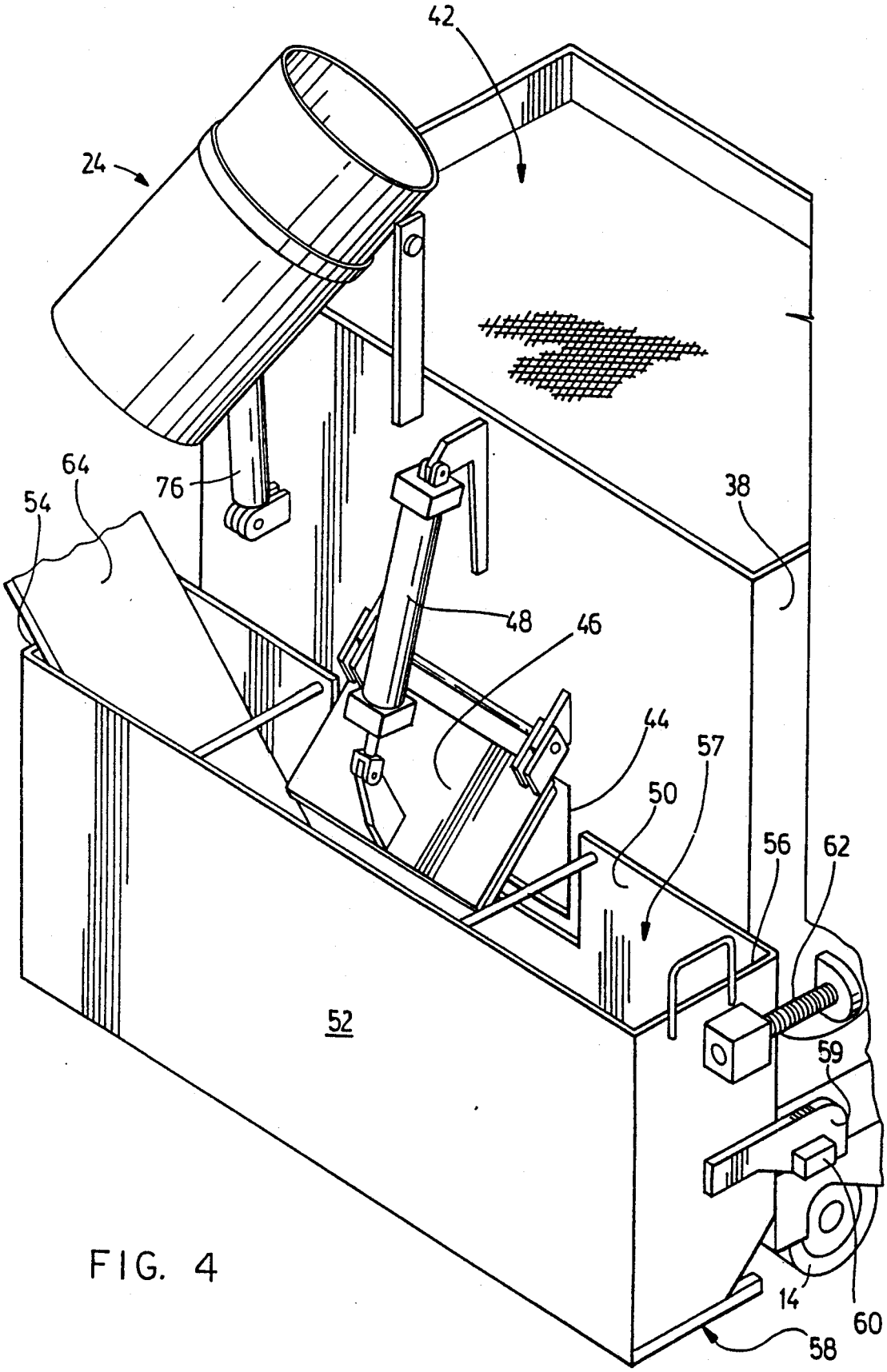
FIG. 4 is an enlarged perspective illustration of the distribution portion of the applicator of FIG. 1.

Referring first of all to FIG. 1, it will be seen that the invention comprises, in this preferred embodiment which is illustrated here for the sake of example only, an essentially mobile applicator device indicated generally as 10. The applicator device 10 comprises a moveable frame assembly 12 having generally a pair of rear wheels 14, and a front wheel assembly 16, the front wheel assembly 16 being steerable, and also being powered by means yet to be described.

Mounted upon frame 12, is a power housing 18 and a mixing chamber 20. The chamber 20 contains any suitable form of mixing apparatus, described below, by means of which the components of the floor surfacing system may be mixed.

The two components of the system, for example the filler and the resin are adapted to be placed in the chamber 20, by means of the first component hopper 22 for the filler material, and a second component hopper 24 for the resin material. The hoppers 22 and 24 are mounted by means to be described below, so that they may be filled with predetermined quantities of components of the system, and then dumped into the mixing chamber 20 when desired.

A distribution box 26 is mounted on the rear of the mixing chamber 20, and is adapted to distribute the mixed surfacing or flooring system directly onto the floor.

These various main sub-assemblies and components will now be described in more detail in relation to the FIGS. 2 to 6 which will now be described in more detail below.

Frame Assembly

The frame assembly 12 will be seen to comprise any suitable form of frame made up of components such as the side members 30—30, and cross members, the nature of which will be well understood by those skilled in the art. Adjacent the front end of the frame assembly, in this particular embodiment, the two side members 30—30 extend upwardly at 30A. The two upward portions 30A—30A, of the frame meet at a junction portion 32, on which the front wheels 16 are supported, and powered, by means yet to be described.

The rear wheels 14 are mounted on the two parallel frame portions 30—30, and are adjustable in height, by means yet to be described, relative to the frame.

Mounted in the housing 18 on the frame, are suitable prime mover power motor means indicated generally at 34, which may be a small prime mover such as a gasoline engine, or for example an electrical motor operated by suitable rechargeable batteries or the like such as are well known in the art and require no description. The motor 34 operates a hydraulic pump 36, for transmitting power from the motor to the various locations where it is required.

MIXING MEANS

Mounted on the frame 12, and located above and behind the motor and pump, is the mixer chamber 20. The chamber 20, in this embodiment, is an essentially horizontal semi-cylindrical container 38, and contains an agitator assembly 40 therein, which in this embodiment is rotatable around a horizontal axle 41. Suitable power transmission means (not shown) are supplied for transmitting power from the motor and pump to the agitator assembly.

However, the invention is not to be taken as restricted to such a chamber with a horizontally oriented agitator, but comprehends other forms of mixing chambers and agitators.

The chamber 38 defines an open top 42, through which raw material may be added. In addition, the chamber is provided with a lower dispensing opening 44, for dispensing the material after it has been mixed. The dispensing opening 44 is normally closed by means of a door 46. The door 46 is movably operated by means of an hydraulic cylinder 48, powered through the pump and motor already described.

It will thus be appreciated that the door 46 would normally be closed, during filling of material into the chamber, and during the mixing of the material in the chamber. When thoroughly mixed the material will then be dispensed simply by opening the door 46, and allowing the material to flow outwardly under the influence of gravity and the motion of the mixing device. (i.e. it is pushed out of the opening by the mixing paddles)

DISTRIBUTION MEANS

In order to control the dispensing of the material from the chamber, the distributor box 26 is provided. The distributor box 26 consists essentially of a rectangular structure having front and rear walls 50 and 52, and side walls 54 and 56. The top 57 and also the bottom 58 of the distributor box are open, in this embodiment.

The distributor box 26 is releasable attachable to the chamber. The releasable attachment means comprise hook members 59 interengageable with abutment members 60, and screw locking devices 62 operable to secure box 26 against removal. In this way, the box can be removed and cleaned at the end of the day's usage, or may be interchanged with a narrower box if desired, for certain applications. Handles may be provided on the box 26 as shown.

In order to distribute the material evenly across the width of the box 26, a manual paddle 64 may be used, in some cases. The paddle is simply placed in the top of the box, and is used to guide the material either to one side or to the other, in order to distribute the material.

However the invention is not restricted to such manual distribution, but it envisages the possibility of using a distribution mechanism within the box 26, such as for example an auger screw (not shown), or some other form of mechanical means for distributing the material evenly across the box.

It will also be noted that the lower edges of the front and back walls and side walls of the box extend downwardly below the frame 12, and extend rearwardly of the frame so that they are located closely adjacent to the floor surface on which the wheels will be running and trail some distance behind the rear wheels. It will now be understood that by controlling the position of the rear wheels relative to the frame, the distributor box 26 can be raised or lowered relative to the floor. Thus the thickness of the layer of material being applied to the floor can be closely regulated.

LOADING MEANS

In order to load the mixing chamber with the raw material components in the correct proportions, the first and second component hoppers 22 and 24 (already referred to) are provided. The first component hopper 22 is swingably mounted on hinge means 70, and may be swung between the upright filling position and the tilted dumping position, by means of the hydraulic cylinder 72 powered by the hydraulic pump and motor already referred to.

Similarly, the second component hopper 24 is swingably mounted by means of the hinges 74, and may be swung to and fro by means of the hydraulic cylinder 76, also powered by the hydraulic pump, and motor already referred to.

The first and second component hoppers may if desired be provided with suitable markings or measuring indicia, by means of which the quantities of the components may be carefully measured. In this way, the operator may simply load a first component (usually a granular filler) in a first predetermined quantity into the first hopper, and a second material, usually liquid multi-component resin material in a second predetermined quantity of liquid into the second hopper. By operating the two hydraulic cylinders, the contents of the two hoppers may then simply be dumped into the mixing chamber.

In this way, each batch of the two materials placed in the mixing chamber can be precisely regulated, so as to ensure that each batch contains the correct proportions of components for that particular system.

It will of course be appreciated that there may be various such flooring systems which may require components in various proportions, varying from one system to another. As far as possible the apparatus according to the invention should be adaptable for use with any of such flooring systems. Each such system will depend upon the specifications supplied by the manufacturer or formulator of the particular raw materials. Different such systems may have different qualities and ratings for particular purposes. Thus a flooring applicator may wish to offer to customers various different systems for different purposes, and in so doing will wish to make use of the apparatus in accordance with the invention for applying whichever system is most suitable for, or is selected by a particular customer.

It will be seen that by the use of the invention, such adaptability is readily achieved.

POWER MOVEMENT MEANS

In order to move the apparatus around the floor, power operated movement means are provided for the front wheel assembly 16 in the form of an hydraulic motor 80, driving a pair of front wheels 82, and itself driven via hoses 84 from the pump and motor already referred to.

Front wheels 82 are themselves mounted on a moveable sub-frame 86, which is in turn, mounted to frame portion 32 of frame 12, as at pivot 88.

A guide handle 90 enables the sub-frame 86 carrying wheels 82 to be guided around the floor.

Suitable controls represented as 92, on the handle 90, may be operated, so as to control the speed.

Control buttons 94 are provided on the handle, for controlling the operation of the various hydraulic cylinders for operation in the manner described above.

REAR WHEEL MOUNTING

The rear wheels 14 in this embodiment (FIG. 6) are mounted on an axle 95, carried on arms 96. Arms 96 are pivotally mounted on side frames 30 at 97. A threaded rod 98 extends between one side frame 30 and arms 96 so as to control their angular position relative to side frames 30. In this way the height of the distribution box relative to the floor F can be adjusted. A height sensor 99 may be provided on side frame 30 if desired.

As mentioned above, various modifications may be made to the invention without departing from the scope of the invention.

Figure 7:
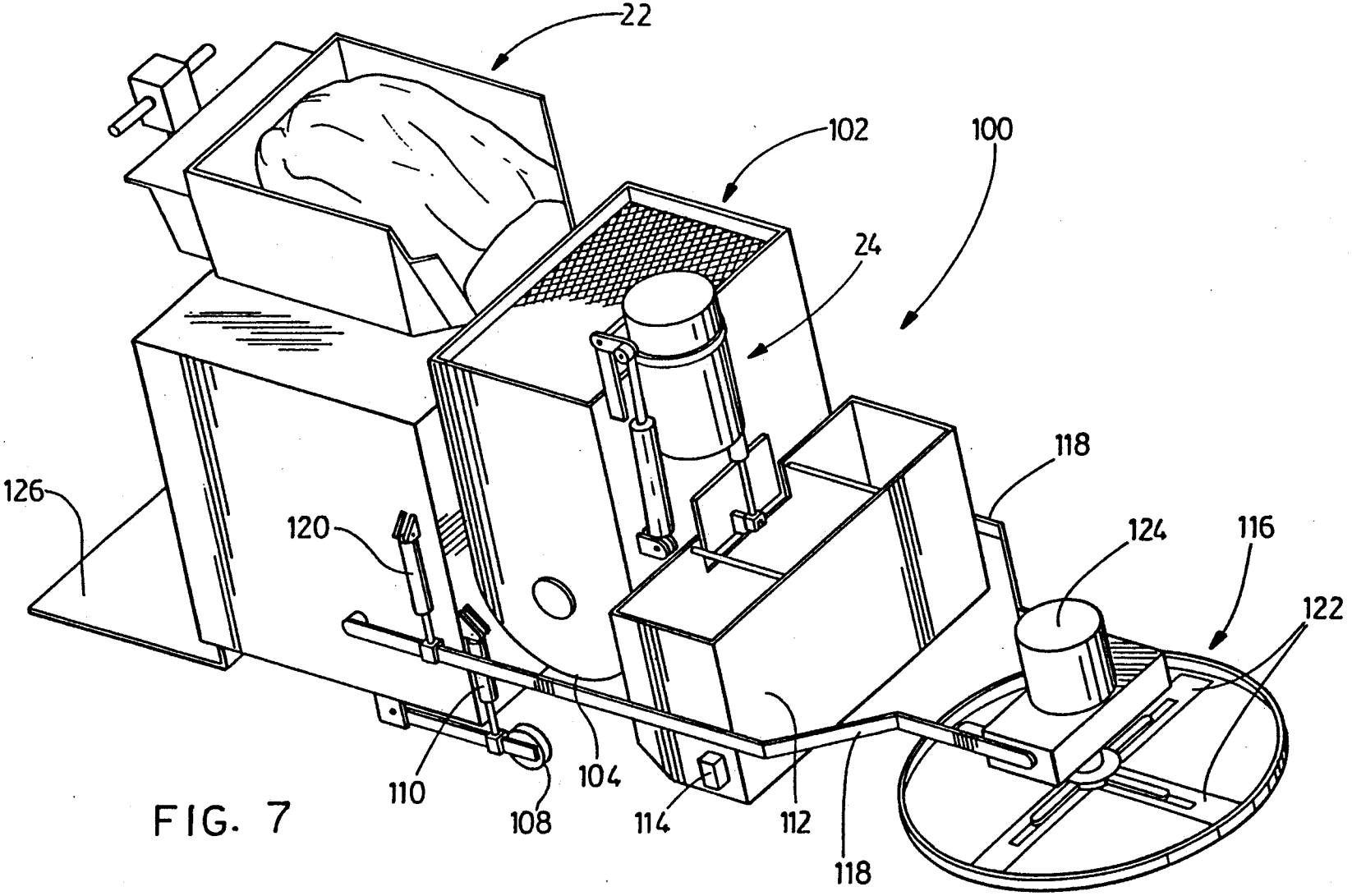
FIG. 7 is a perspective illustration of a further embodiment of the applicator of FIG. 1, showing power-operated trowelling attachments, and a riding platform.

As shown in FIG. 7, a modified form of applicator device 100 will be seen to be generally similar to the applicator device indicated in FIG. 1. The mixer 102 is a generally rectangular shaped chamber, having a semi-cylindrical bottom 104. A rotary paddle is mounted on a horizontal axis for rotation in the lower portion of the mixer 102, for mixing the contents.

In this embodiment, the rear wheels 108 may be adjusted upwardly and downwardly by means of hydraulic cylinders 110. Positioning of the distribution box 112 relative to the floor may be controlled by means such as the laser distance sensor 114, in turn controlling the hydraulic cylinders 110.

A power trowelling attachment indicated generally as 116 may be swingably mounted on arms 118 controlled by hydraulic cylinders 120. Paddle arms 122 may be rotated by means of an hydraulic motor 124.

In addition, a ride-on guidance platform 126 is provided at the front end of the machine. This permits an operator to actually stand on the machine and guide it about the floor while riding on the platform.

The foregoing is a description of a preferred embodiment of the invention which is given here by way of example only. The invention which is not to be taken as limited to any of the specific features as described, but comprehends all such variations thereof as come within the scope of the appended claims.

What is claimed is:

1. A flooring material applicator device for applying a flooring material, said material having a granular component and a liquid component, to a floor and comprising;

frame means, and wheel means therefore, rendering said frame means moveable about a floor;

a mixer chamber means on said frame means, and agitator means located therein, and being moveable therein whereby to mix said granular and liquid components of said flooring material therein;

a first component receptacle means for receiving said granular component, movably mounted adjacent said mixer chamber means, and being moveable between a first loading position, and a second dumping position, wherein the granular component thereof is dumped into said mixer chamber means;

a first cylinder connected to said first component receptacle, and operable whereby to procure said movement of said first component receptacle between said loading position and said dumping position and back again;

a second component receptacle means for receiving said liquid component, movably mounted adjacent said mixer chamber means, and being moveable between a first loading position and a second dumping position, wherein the liquid component thereof may be dumped into said mixer chamber means;

movement means connected to said second component receptacle means for procuring movement thereof;

a distribution opening in said mixer chamber means, and door means movably operable to open and close said opening;

distribution chamber means adjacent said opening, whereby to receive flooring material when said door means is open;

power-operated means for operating said agitator, said second component receptacle means, and said door means, and;

control means for said device whereby said device may be guided about a floor, whereby flooring material deposited in said distribution chamber means from said mixer chamber means, may be spread about a floor, during movement of said device.

2. A flooring material applicator device as claimed in claim 1 and wherein said frame means defines a front end and a rear end, and wherein said distribution chamber means is mounted adjacent said rear end, whereby said device may be moved in a forward direction, with said front end leading and said rear end trailing, with said material being deposited behind said device.

3. A flooring material applicator device as claimed in claim 1 and wherein said first component receptacle means is of a first predetermined size and wherein said second component receptacle means is of a second predetermined size different from said first predetermined size, whereby to provide for measuring of respective said granular component and said liquid component of said flooring material prior to mixing.

4. A flooring material applicator device as claimed in claim 1 and wherein said distribution chamber means comprises a generally rectangular box-like structure, and releasable attachment means for securing said distribution chamber means in position adjacent said opening in said mixer chamber means and located rearwardly of said wheel means.

5. A flooring material applicator device as claimed in claim 4 wherein said releasable attachment means comprises hook members secured to said distribution chamber means, and abutment members secured to said frame means, said hook members being interengagable with said abutment members, and further including screw locking devices extending between said mixing chamber means and said distribution chamber means, said screw locking devices and said hook members cooperating to hold said distribution chamber means in position adjacent said mixing chamber means.

6. A flooring material applicator device as claimed in claim 1 and wherein said wheel means includes at least one pair of adjustable wheel members, and means for adjustably raising, and lowering said adjustable wheel members, whereby the position of said distribution chamber means relative to a floor may be adjusted, and one pair of steerable wheel members, operable to steer said device.

7. A flooring material applicator device as claimed in claim 1 and wherein said wheel means includes front wheel means, and power-operated means for driving said wheel means, and means for controlling said power-operated means whereby said device may be controllably moved by said power-operated means around said floors.

8. A flooring material applicator device as claimed in claim 1 and including trowelling means mounted on said frame means, extending rearwardly of said device, and operable to apply surface treatment to said flooring material after said material has been deposited upon the floor from said distribution chamber means.

9. A flooring material applicator device as claimed in claim 1 and wherein said movement means connected to said second component receptacle means comprises a cylinder connected to said second component receptacle means, whereby to procure movement thereof from said first loading position, to said second dumping position, and back again.

10. A flooring material applicator device as claimed in claim 1 wherein said door means comprises a door mounted on said mixing chamber and wherein said power operated means for operating said door comprises a cylinder, connected to said door, whereby said door may be moved between a closed position, and an open position.

* * * * *